US006857228B2

(12) United States Patent
Kunz et al.

(10) Patent No.: US 6,857,228 B2
(45) **Date of Patent: *Feb. 22, 2005**

(54) COUNTERBALANCE SYSTEM FOR A TILT-IN WINDOW

(75) Inventors: John R. Kunz, Douglassville, PA (US); Keith Kannengieszer, Hatfield, PA (US)

(73) Assignee: John Evans Sons, Inc, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/439,164

(22) Filed: May 16, 2003

(65) Prior Publication Data

US 2004/0206002 A1 Oct. 21, 2004

Related U.S. Application Data

(63) Continuation-in-part of application No. 10/417,598, filed on Apr. 18, 2003.

(51) Int. Cl.[7] ..... E05D 15/22
(52) U.S. Cl. ..... 49/181; 49/445; 16/197
(58) Field of Search ..... 49/181, 176, 445, 49/446, 447; 16/197, 199, 200, DIG. 16

(56) References Cited

U.S. PATENT DOCUMENTS 3,399,490 A * 9/1968 Hettinger ..... 49/414
3,842,540 A * 10/1974 Anderson ..... 49/181
4,227,345 A * 10/1980 Durham, Jr. ..... 49/181
4,364,199 A * 12/1982 Johnson et al. ..... 49/181
4,452,012 A * 6/1984 Deal ..... 49/181
4,837,976 A * 6/1989 Westfall et al. ..... 49/430
4,930,254 A * 6/1990 Valentin ..... 49/181
5,157,808 A * 10/1992 Sterner, Jr. ..... 16/197
5,210,976 A * 5/1993 Cripps ..... 49/181
5,353,548 A * 10/1994 Westfall ..... 49/446
5,452,495 A * 9/1995 Briggs ..... 16/193
5,855,092 A * 1/1999 Raap et al. ..... 49/181
6,032,417 A * 3/2000 Jakus et al. ..... 49/181
6,058,653 A * 5/2000 Slocomb et al. ..... 49/181
6,119,398 A * 9/2000 Yates, Jr. ..... 49/181
6,658,794 B1 * 12/2003 Hansel et al. ..... 49/181

* cited by examiner

*Primary Examiner*—Gregory J. Strimbu
(74) *Attorney, Agent, or Firm*—LaMorte & Associates

(57) ABSTRACT

A counterbalance system for a tilt-in window that has tilt post brackets. The tilt post brackets selectively mount to the vertical side elements of a window sash. Accordingly, the tilt post brackets need not be manufactured into the structure of the sash. Each tilt post bracket has a vertical section that mounts directly with the vertical side elements of the window sash frame. A brake element extends from the vertical section, therein providing the window sash with a tilt-in pivot post. The brake element provides both a braking system and a curl spring support structure.

12 Claims, 7 Drawing Sheets

COUNTERBALANCE SYSTEM FOR A TILT-IN WINDOW

This is a continuation in-part of application Ser. No. 10/417,598, filed on Apr. 18, 2003.

BACKGROUND OF THE INVENTION

1. Field of the Invention

In general, the present invention relates to counterbalance systems for windows that prevent open window sashes from closing under the force of their own weight. More particularly, the present invention system relates to counterbalance systems for tilt-in windows that use curl springs to create a counterbalancing force.

2. Description of the Prior Art

There are many types and styles of windows. One of the most common types of window is the double-hung window. A double-hung window is the most common window found in traditional home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can also be selectively tilted into the home so that the exterior of the sashes can be cleaned from within the home.

The sash of a double-hung window has a weight that depends upon the materials used to make that window sash and the size of the window sash. Since the sashes of a double-hung window are free to move up and down in the frame of a window, some counterbalancing system must be used to prevent the window sashes from always moving to the bottom of the window frame under the force of their own weight.

For many years counterbalance weights were hung next to the window frame in weight wells. The weights were attached to the window sash using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl framed windows. As such, the prior art concerning vinyl framed windows is herein addressed.

Vinyl framed, tilt-in, double-hung windows are typically manufactured with tracks along the inside of the window frame. Brake shoe mechanisms, commonly known as "shoes" in the window industry, are placed in the tracks and ride up and down within the tracks. Each sash of the window has two tilt pins or tilt posts that extend into the shoes and cause the shoes to ride up and down in the tracks as the window sashes are opened or closed.

The shoes serve two purposes. First, the shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Second, the shoes support curl springs. Curl springs are constant force coil springs that supply a constant retraction force when unwound. Traditionally, curl springs are placed within the shoe in the same way a metal tape is placed within the housing of a tape measure. One end of the curl spring is anchored to the frame of the window while the main body of the curl spring is wound inside of the shoe. As the shoes move within the tracks, the curl spring rotates inside the shoe. Often as the curl spring rotates inside the shoe, the curl spring moves around within the confines of the shoe and makes an undesirable noise.

Single curl springs are used on windows with light sashes. Multiple curl springs are used on windows with heavy sashes. The curl springs provide the counterbalance force to the window sashes needed to maintain the sashes in place. The counterbalance force of the curl springs is transferred to the window sashes through the structure of the shoes and the tilt posts that extend from the window sash into the shoes.

Prior art shoes that contain braking mechanisms and support counterbalance curl springs are exemplified by U.S. Pat. No. 6,378,169 to Batten, entitled Mounting Arrangement For Constant Force Spring Balance; U.S. Pat. No. 5,463,793 to Westfall, entitled Sash Shoe System For Curl Spring Window Balance; and U.S. Pat. No. 5,353,548 to Westfall, entitled Curl Spring Shoe Based Window Balance System.

Prior art shoes for curl spring counterbalance systems are complex assemblies. The shoes must contain a brake mechanism strong enough to lock a sash in place. Furthermore, the shoes must engage and retain the end of at least one strong curl spring. Prior art shoes are always in contact with the tracks on the sides of the window frame. Accordingly, as wear, dirt and grime accumulate over time, it often becomes more difficult for the shoes to move up and down. The shoe of a window assembly therefore often malfunctions.

If a shoe jams or otherwise malfunctions, the shoe may not enable the tilt post of the window sash to rotate freely as the window sash is tilted inward. As a window sash is tilted inward, a large torque is experienced by the tilt post at the base of the window sash. This torque is used to activate the braking mechanism in the shoe. However, if the shoe jams, slides out of its track, or otherwise malfunctions, the shoe may not allow the tilt post of the window sash to rotate freely. Consequently, the large torque force, created by the window sash being tilted, acts upon the tilt post at the bottom of the window sash. If the tilt post is not free to rotate, the torque force often bends the tilt post or breaks the tilt post off the sash. Once the tilt post is so damaged, it must be replaced. In many models of windows, the tilt post is manufactured as part of the sash structure and cannot be replaced. In such a construction, the entire window sash must be replaced if the tilt post becomes damaged.

Furthermore, the manufacturing process used to create a window sash with an integral tilt post is complex. As such, the cost of manufacturing such a window sash is far greater than it would be if no tilt post were present.

A need therefore exists in the field of vinyl, tilt-in, double-hung windows, for a counterbalance system that eliminates the need for shoes. A need also exists in the field of vinyl, tilt-in double-hung windows for a counterbalance system that provides inexpensive, easily installed tilt posts for a window sash. As such, window assemblies can be made more reliable, less noisy, less expensive and easier to repair. These needs are met by the present invention as described and claimed below.

SUMMARY OF THE INVENTION

The present invention is a counterbalance system for a tilt-in window that has a specific form and function for the tilt post bracket component of that system. The tilt post bracket selectively attaches to the vertical side elements of a window sash. Accordingly, a tilt post need not be manufactured into the structure of the sash. The tilt post bracket has a vertical section that mounts directly against the exterior of the window sash frame or within the structure of the window sash frame. A brake element extends from the vertical section, therein providing the window sash with a tilt-in pivot post.

The counterbalance system uses wound spring elements to provide a counterbalancing force to the sashes of the window. The wound springs are configured to define open central regions. Hubs are attached to tilt post brackets that extend from the sashes of the window. The hubs extend into the open central regions of the wound springs, thereby supporting the wound springs within the frame of the window. The brake element is disposed between the wound springs and the remainder of the tilt post brackets. The brake element automatically locks the horizontal post of the tilt post brackets into fixed positions as the sashes of the tilt-in window are tilted inwardly. The brake element creates two braking actions. First, the brake element itself creates an interference fit within the frame of the window as the sashes tilt. Second, the brake element displaces the wound spring and causes the wound spring to press against the frame of the window as the sashes tilt. The two separate braking actions create a strong and effective brake for the tilt posts of the sashes without the use of traditional window brake shoe assemblies.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
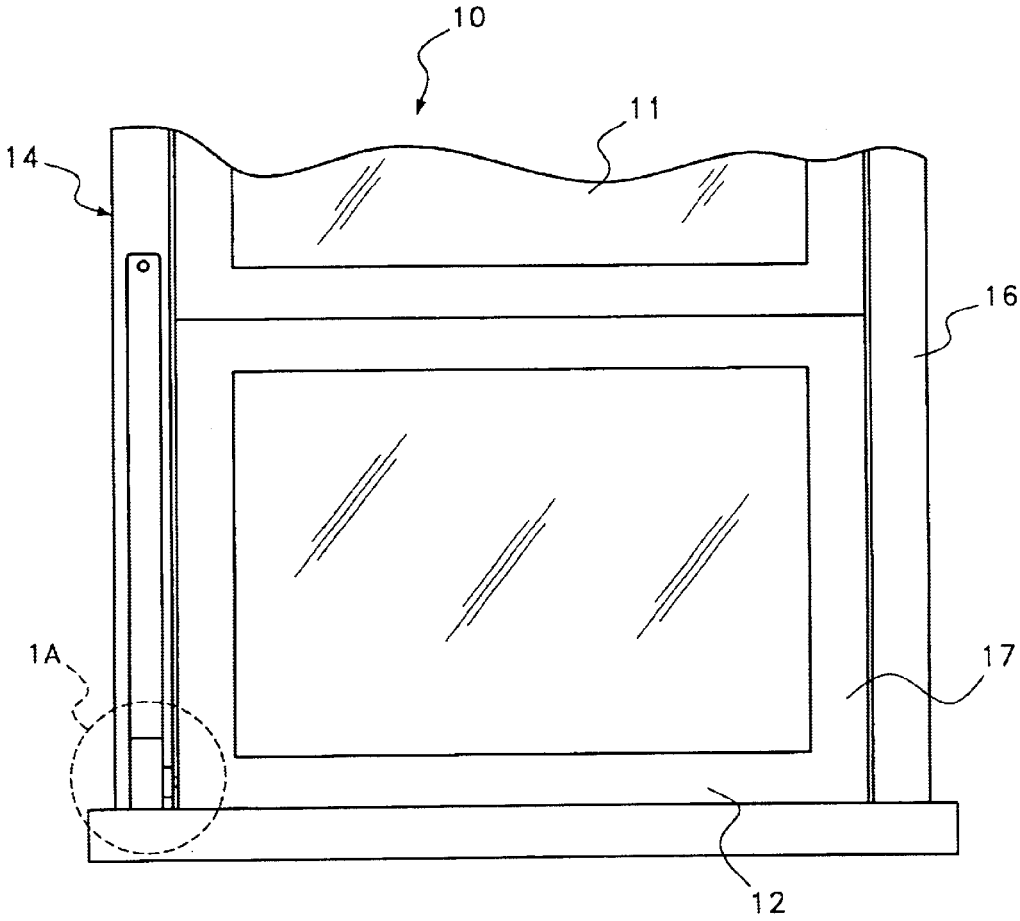
FIG. 1 is a partially fragmented view of a window assembly in accordance with the present invention.

Referring to FIG. 1, there is shown an exemplary embodiment of a vinyl, tilt-in, double-hung window assembly 10. The window assembly 10 has an upper sash 11 and a lower sash 12. Each of the sashes 11, 12 has two side elements 17. The upper sash 11 and the lower sash 12 are contained within a window frame 14. The window frame 14 has two vertical sides 16 that extend along the side elements 17 of both sashes 11, 12. Within each of the vertical sides 16 of the window frame 14 is formed a track 18.

Figure 1A:
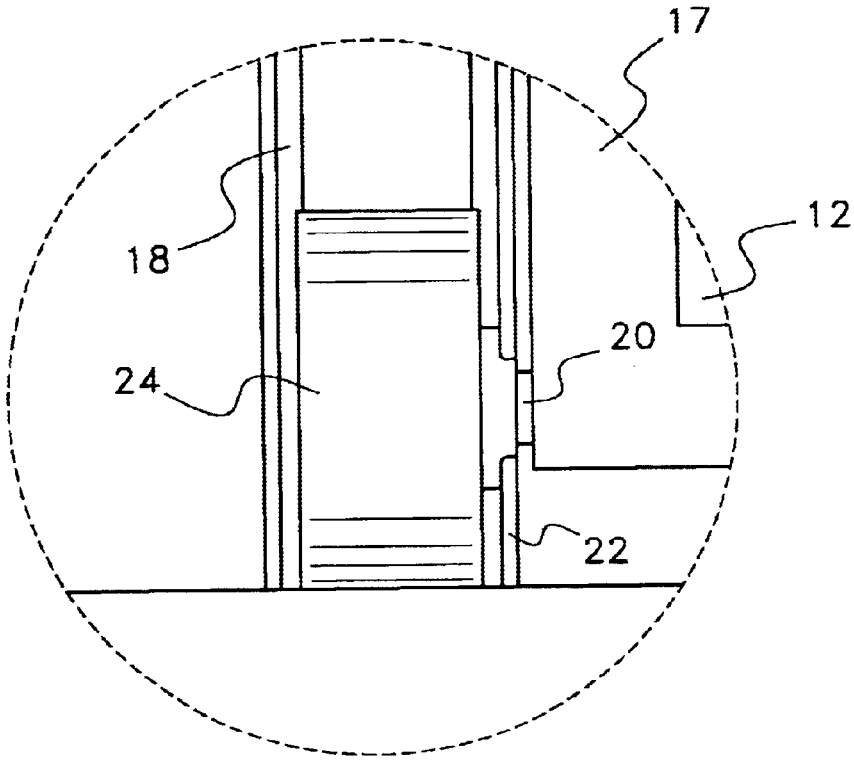
FIG. 1A is a enlarged view of the counterbalance system contained tin section 1A of FIG. 1.

Referring to FIG. 1A in conjunction with FIG. 1, it can be seen that a tilt post bracket 20 is mounted to the side elements 17 of each sash 11, 12 near the bottom of each sash 11, 12. Each tilt post bracket 20 contains a brake head 22 that extends out away from the side of the sash 11, 12 and into the tracks 18 in the vertical sides 16 of the window frame 14. As is later explained in greater detail, a brake head 22 extends away from the sash 11, 12 and into the track 18 of the window frame 14. The brake head 22 serves two purposes. First, the brake head 22 serves as a brake mechanism that locks the bottom of a sash 11, 12 in place within the track 18 when a sash 11, 12 is tilted inwardly. Second, the brake head 22 serves as a hub for a curl spring 24, wherein a curl spring 24 passes around the brake head 22.

The curl spring 24 rotates about the brake head 22. The free end of the curl spring 24 is affixed to the window frame 14 higher along the track 18. Accordingly, the curl spring 24 applies an upward counterbalance force to each sash 11, 12 that counteracts the weight of each sash 11, 12.

Figure 2:
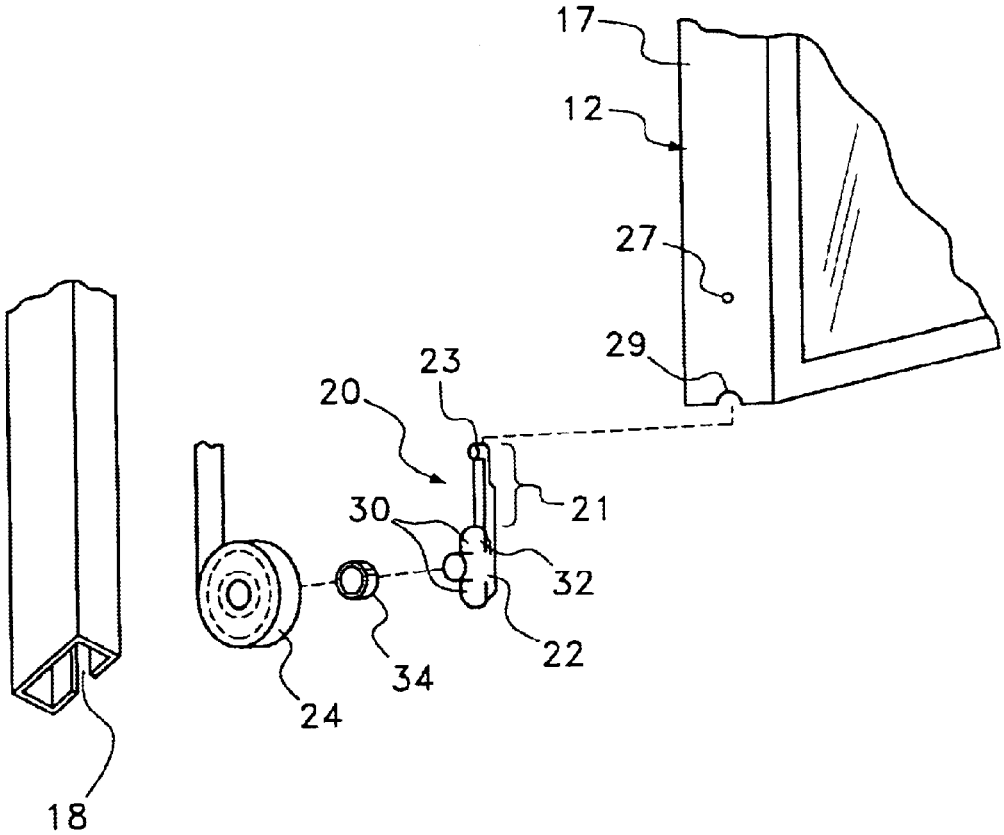
FIG. 2 is a perspective, exploded view of the counterbalance system shown in FIG. 1.

Referring to FIG. 2, it can be seen that the tilt post bracket 20 is a structure that has an elongated vertical section 21. Disposed at the top of the vertical section 21 is a locking projection 23. The locking projection 23 is used to lock the tilt post bracket 20 in place, as will later be explained.

The vertical section 21 of the tilt post bracket 20 can be mounted flush to the side element 17 of a window sash 12 or placed in a relief formed in the exterior of the side element 17. However, in a preferred embodiment, the vertical section 21 of the tilt post bracket 20 passes into the interior of the side element 17 of the sash 12, in a manner later explained. To facilitate the interconnection between the vertical section 21 of the tilt post bracket 20 and the sash 12, the side elements 17 of the sash 12 are slightly modified. As will be later shown, the interior of each side element 17 of the sash 12 is not solid. Rather, although each side element 17 of the sash has a solid exterior, internally each side element 17 of the sash 12 is hollow and is reinforced with cross-ribbing. In this manner, the side elements 17 of the sash 12 can be made lighter, stronger and at a lower cost than if the side elements 17 were solid vinyl. In the present invention, a locking hole 27 is formed in each of the side elements 17. At the base of each side element 17 a relief 29 is formed, to help receive the tilt post bracket 20, as is later shown.

The brake head 22 extends horizontally from the bottom of the vertical section 21 of the tilt post bracket 20. In the shown embodiment, the brake head 22 is shown as an integral part of the tilt post bracket 20. As a result, the brake head 22 and the vertical section 21 of the tilt post bracket 20 are a single unistructural part. It should be understood, however, that such a configuration is exemplary and that the brake head 22 and the remainder of the tilt post bracket 20 can be made as separate parts. In such an alternate configuration, the brake head 22 is structured so that it passes over the end of a horizontal post that extends from the tilt post bracket 20. The interconnection between the brake head 22 and the tilt post bracket 20 is a keyed connection that prevents the brake head 22 from being rotated without the remainder of the tilt post bracket 20.

The brake head 22 is a structure that includes flanges 30 and a cylindrical hub 32 that extends behind the flanges 30. The purpose and function of the flanges 30 is later explained. The cylindrical hub 32 is sized to pass into an annular spring bearing 34. As such, the annular spring bearing 34 is free to rotate around the cylindrical hub 32 of the brake head 22. The spring bearing 34 passes into the center of a standard window curl spring 24. The spring bearing 34 may be slotted so that the spring bearing 34 can be momentarily compressed when inserted into the center of the curl spring 24. Alternatively, the spring bearing 34 may have fingers or other features that mechanically engage the curl spring 24 and lock the spring bearing 34 into place in the center of the curl spring 24. Once inserted into the center of the curl spring 24, the spring bearing 34 expands so that no space exists between the exterior of the spring bearing 34 and the interior of the curl spring 24.

Figure 3:
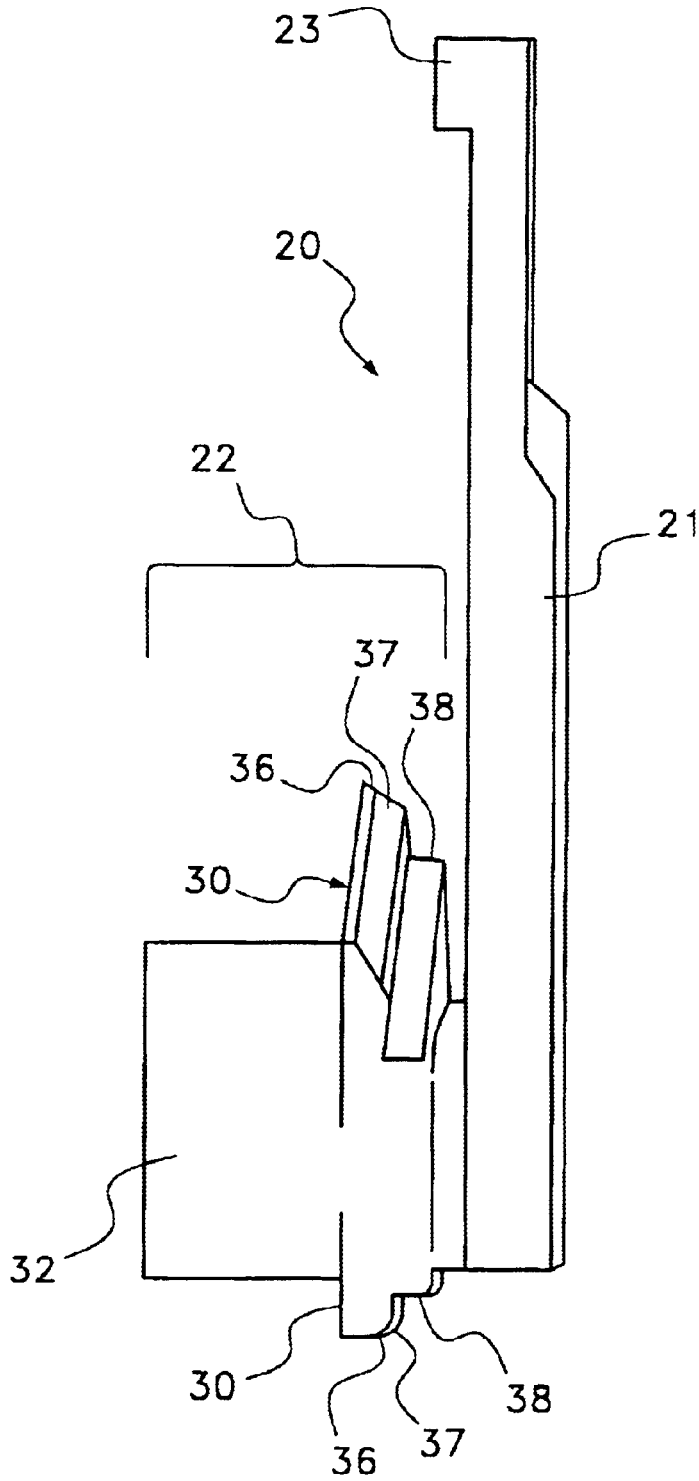
FIG. 3 is a perspective view of a single-piece brake head/tilt post bracket assembly.

Referring to FIG. 3, the brake head 22 and tilt post bracket 20 are shown combined in a single piece. From FIG. 3, it can be seen that the brake head 22 has a complex shape. The cylindrical hub 32 of the brake head 22 comprises the majority of the brake head 22. However, flanges 30 radially extend from the cylindrical hub 32 at one end of the cylindrical hub 32. The flanges 30 extend above and below the cylindrical hub 32. No flanges 30 extend from the sides of the cylindrical hub 32. As a result, the flanges 30 combine to provide the brake head 22 with an elongated configuration at one end of the cylindrical hub 32.

The flanges 30 above and below the cylindrical hub 32 have a stepped structure. Each of the flanges 30 has a distal edge 36 at their tip and a second edge 38 interposed between the distal edge 36 and the center of the hub 32. The flanges 30 have a first thickness near the distal edge 36. Further down from each distal edge 36 is a step that forms the second edge 38. Accordingly, below the second edge 38, the flanges 30 are thicker and lay flush with the front end of the cylindrical hub 32. However, above the second edge 38, the flanges 30 are recessed. The flanges 30 are further thinned near the distal edge 36 by the presence of a bevel 37 that leads to the distal edge 36.

The vertical section 21 of the tilt post bracket 20 also has a complex shape. The vertical section 21 has a locking projection 23 at its top end. The length of the vertical section 21 between the brake head 22 and the locking projection 23 is also varied. The purpose of the varied shape is to cause the vertical section 21 of the tilt post bracket 20 to conform to the internal shape of a void in the side element 17 (FIG. 2) of the window sash 12 (FIG. 2).

Figure 4:
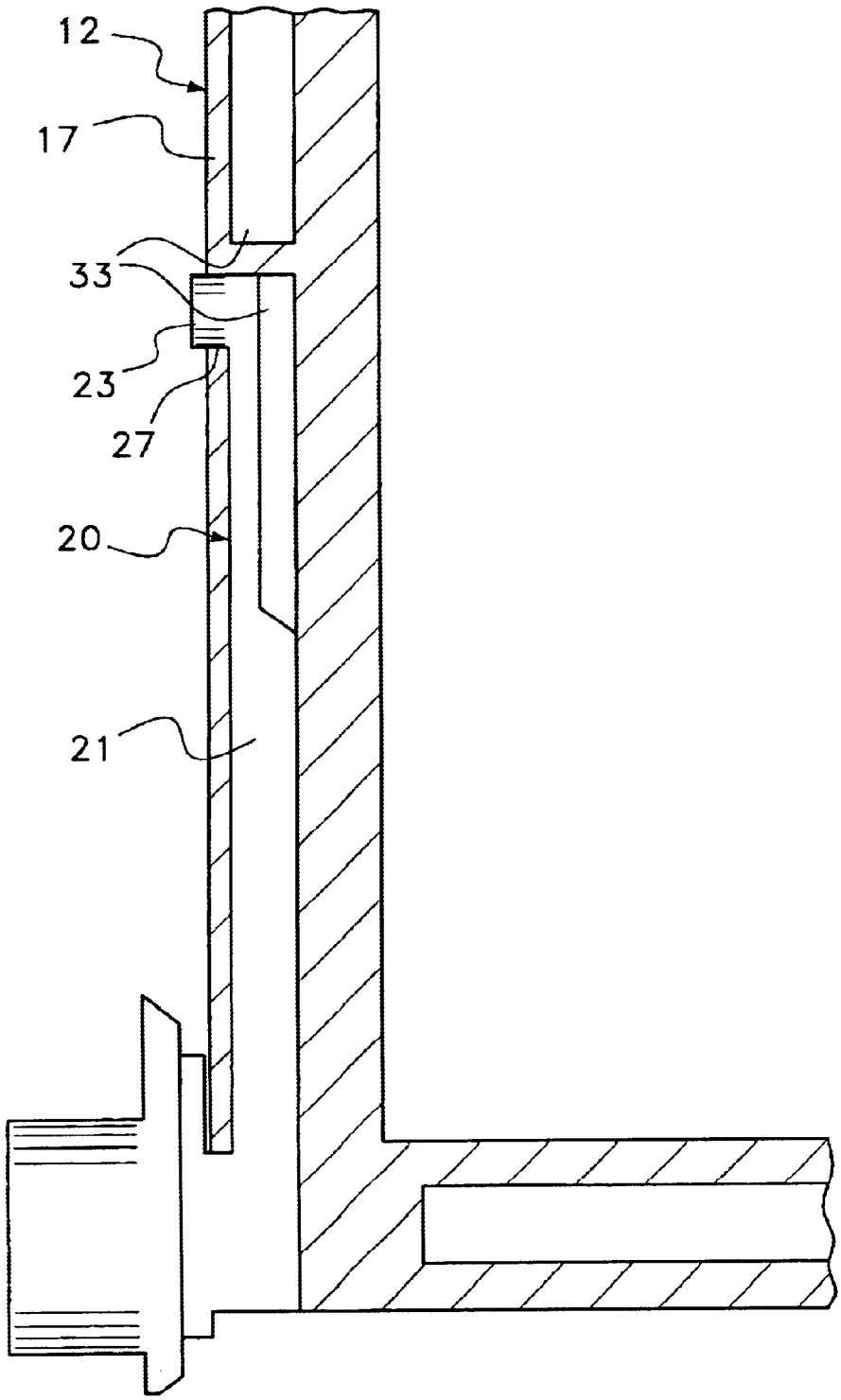
FIG. 4 is a selectively cross-sectioned view of a window sash showing how the tilt post bracket mounts within the sash.

Referring to FIG. 4, it can be seen that within the side elements 17 of the sash 12 are voids 33. The voids 33 are molded into the vinyl structure of the sash's side elements 17 to reduce weight, reduce cost, reduce expense and increase strength. The vertical section 21 of the tilt post bracket 20 extends into a void 33 in the side element 17 of the sash 12. The vertical section 21 of the tilt post bracket 20 is sized to be the same size as the void 33, so as to fill the void and create maximum surface-to-surface contact between the vertical section 21 and the defining surfaces of the void 33.

From FIG. 4, it can be seen that the vertical section 21 thins near the locking projection 23. As such, the vertical section 21 of the tilt post bracket 20 is slightly flexible in the thinned area below the locking projection 23. Accordingly, as the vertical section 21 of the tilt post bracket 20 passes into the void 33 in the sash's side element 17, the vertical section 21 below the locking projection 23 will deform slightly until the locking projection 23 reaches the locking hole 27. Once at the locking hole 27, the locking projection 23 pops into the locking hole 27 and the vertical section 21 is no longer slightly deformed. Accordingly, the passing of the locking projection 23 into the locking hole 27 mechanically locks the tilt post bracket 20 into the side element 17 of the sash 12.

Back in FIG. 2, a relief 29 was shown at the bottom of the side element 17 of the sash 12. In FIG. 4, it can be seen that the relief 29 (shown only in FIG. 2) allows the tilt post bracket 20 to pass into side element 17 of the sash 12 so as not to protrude too far below the bottom of the sash 12.

Figure 5B:
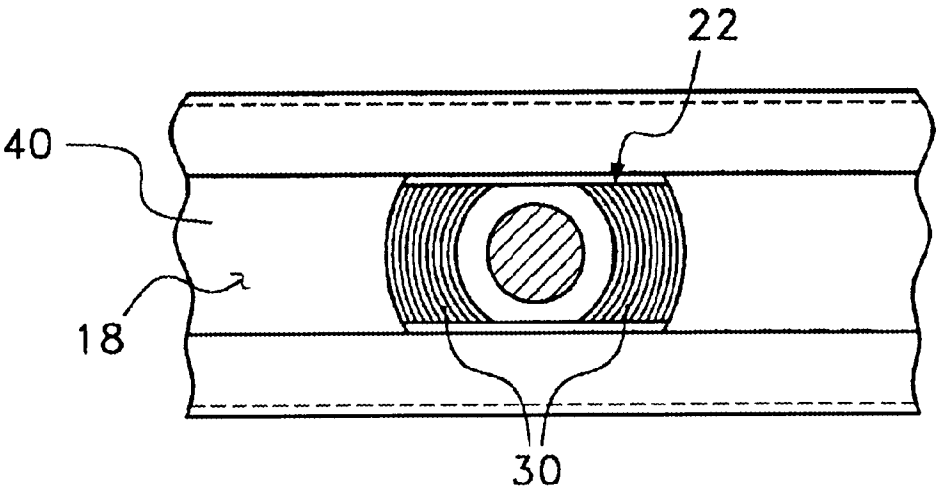
FIG. 5B is a front view of the counterbalance system shown in FIG. 5A.
Figure 5A:
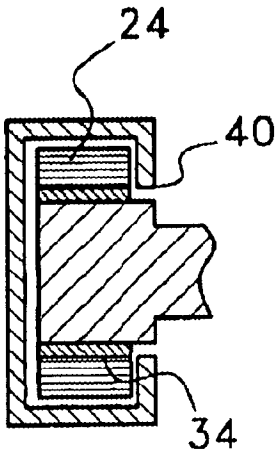
FIG. 5A is a side view of the counterbalance system in a window frame track.

Referring now to FIGS. 5A and 5B, it can be seen that the track 18 in each side of the window frame is accessible through a long slot 40 that runs along the length of the window frame. When the window sash 12 (FIG. 1) is not tilted, the tilt post bracket 20 (FIG. 2) orients the brake head 22 in the track 18 so that the flanges 30 on the brake head 22 do not engage the window track 18 or the slot 40 at any point. The brake head 22 is therefore free to move up and down along the length of the track 18 without touching the track 18. The brake head 22 supports the spring bearing 34 (FIG. 2) in the center of the curl spring 24. Accordingly, as the brake head 22 moves up and down in the track 18, the curl spring 24 is moved up and down in the track 18, wherein the curl spring 24 either winds or unwinds depending upon the direction of movement. However, the curl spring 24 is not confined within a shoe, and the only movement of the curl spring 24 is its rotation around the brake head 22. As such, each curl spring 24 is prevented from making contact noise as it winds and unwinds.

It will be understood that when the sash 12 (FIG. 2) of the window is closed, the brake head 22 and the curl spring 24 are both free to move in the track 18. This allows the window sash 12 (FIG. 2) to move up and down unencumbered in the window frame.

Figure 6B:
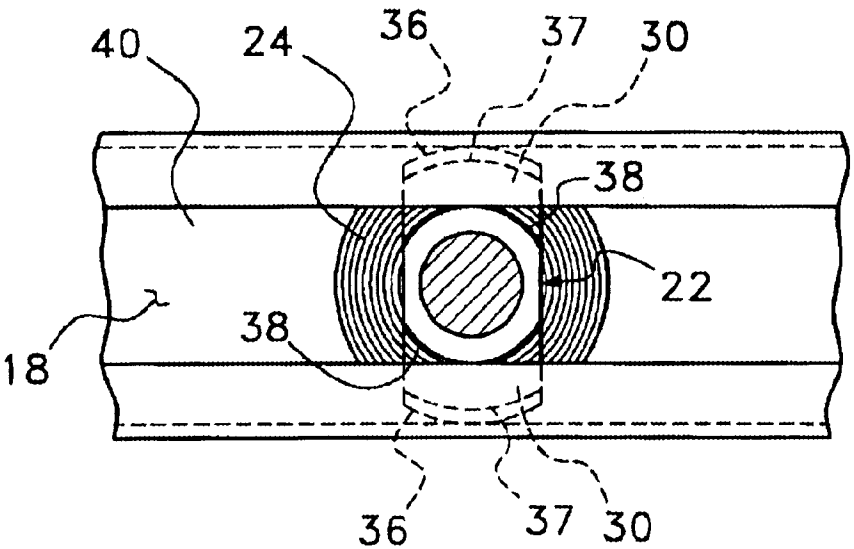
FIG. 6B is a front view of the counterbalance system shown in FIG. 6A.
Figure 6A:
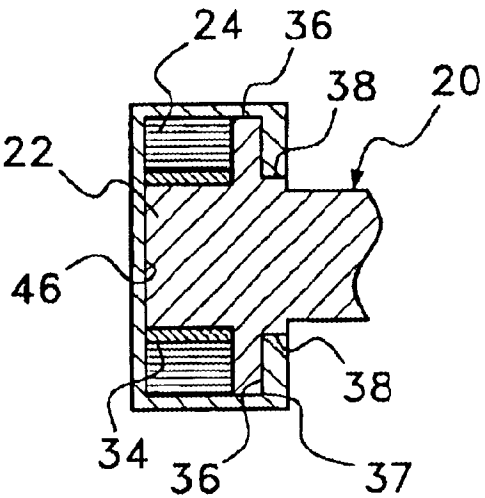
FIG. 6A is a side view of the counterbalance system in a window frame track.

Referring to FIGS. 6A and 6B, it can be seen that when the sash 12 (FIG. 1) of the window is tilted forward, the tilt post bracket 20 rotates. This causes the brake head 22 to rotate in the track 18. As the brake head 22 rotates in the track 18, two simultaneous braking actions occur that lock the brake head 22 in place within the track 18. The first braking action is caused by the flanges 30 that extend from the brake head 22. As the brake head 22 rotates, the flanges 30 rotate towards 90 degrees within the confines of the track 18. The second edges 38 of the flanges 30 rotate within the slot opening 40. The distal edges 36 of the flanges 30 rotate into the track 18 just behind the slot opening 40. The bevel 37 leading to the distal edges 36 of the flanges 30 prevent the distal edges 36 from catching on the open edges of the slot 40 as the flanges 30 rotate past these edges. As the flanges 30 rotate toward 90 degrees, contact occurs between the flanges 30 and the track 18 at two different points. As the distal edges 36 of the flanges 30 rotate, they contact the interior of the track 18, causing an interference fit. Simultaneously, the second edges 38 rotate and contact the open edges of the slot 40. This also causes an interference fit. Consequently, as the brake head 22 rotates, an interference occurs between the structure of the track 18 and both the distal edges 36 and the second edges 38 of the flanges 30.

This wedges the brake head 22 in place and prevents the brake head 22 from being moved in the track 18.

As the brake head 22 is being rotated in the track 18 to cause an interference fit, yet another braking action is occurring. As the brake head 22 rotates in the track 18, the distal edges 36 of the flanges 30 enter the inside of the track 18. Due to the thickness of the flanges 30, the cylindrical hub 32 is driven farther into the track 18 as the distal edges 36 of the flanges 30 rotate into the inside of the track 18.

The cylindrical hub 32 supports the curl spring 24 within the track 18. As the cylindrical hub 32 is driven farther into the interior of the track 18 by the entrance of the flanges 30 into the track 18, the curl spring 24 is driven farther into the interior of the track 18. The brake head 22 is sized so that as the flanges 30 turn into the track 18, the curl spring 24 becomes compressed between the rear wall 46 of the track 18 and the flanges 30 on the brake head 22. The combined width of the curl spring 24 and the flanges 30 of the brake head 22 in the track 18 is wider than the track 18. Thus, an interference fit is created when the brake head 22 is rotated and the flanges 30 enter the track 18. The interference fit biases the curl spring 24 against the rear wall 46 of the track 18. This prevents the curl spring 24 from moving in the track 18. The abutment against the rear wall 46 of the track 18 also hinders the curl spring 24 from winding or unwinding.

Accordingly, when the brake head 22 is rotated from the free moving orientation of FIG. 5A into the locked position of FIG. 6A, multiple locking actions occur. The flanges 30 of the brake head 22 contact the interior of the track 18 and the edges of the slot 40 in the track 18, thereby locking the brake head 22 in place. Furthermore, the brake head 22 biases the curl spring 24 against the rear wall 46 of the track 18, thereby locking the curl spring 24 in place. The combined locking actions create a very strong overall locking mechanism that prevents the tilt post bracket 20 and the curl spring 24 from moving within the window track 18 once the window sash 12 (FIG. 1) is tilted.

From the description of the function of the brake head 22, it will be understood that the brake head 22 itself is a solid object with no moving parts. The brake head 22 is either part of, or attached to, the tilt post bracket 20 and rotates with the tilt post bracket 20. When in a first orientation, the brake head 22 moves freely in the track 18 of the window. When rotated, the brake head 22 creates multiple interferences with both the structure of the track 18 and the curl spring 24 in the track. However, since the brake head 22 itself is a solid, one-piece structure with no moving parts, it is highly reliable and resists wear much better than prior art brake shoes that contain complex moving brake assemblies.

It will be understood that the embodiments of the present invention counterbalance system that are described and illustrated herein are merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. In a tilt-in window assembly having a sash and tracks that extend along opposite sides of the sash, wherein the sash is selectively positionable between a non-tilted position and a tilted position, a counterbalance system for the sash, comprising:

two tilt post brackets, each of said tilt post brackets having a vertical section and a horizontal section that protrudes perpendicularly from said vertical section wherein said vertical section of each of said tilt post brackets is mounted to a respective one of the opposite sides of the sash;

each horizontal section of said tilt post brackets includes a brake structure disposed within a respective one of the tracks, said brake structures being free moving in the tracks when in a first orientation and creating an interference fit with the tracks when rotated to a second orientation, wherein said tilt post brackets retain said brake structures in said first orientation when the sash is in said non-tilted position, and wherein said tilt post brackets rotate said brake structures into second orientation when the sash is moved from said non-tilted position to said tilted position; and a plurality of wound springs, each of said wound springs having a free end anchored in a respective one of the tracks, wherein each wound spring defines a central opening, and wherein each of said brake structures extends the central opening of a respective one of said wound springs, thereby supporting wound springs within the tracks; and wherein said brake structures bias said wound springs against the tracks when said brake structures are in said second orientation.

2. The assembly according to claim 1, wherein the sash has vertical frame elements and said vertical sections said tilt post brackets mount to said vertical frame elements.

3. The assembly according to claim 2, wherein the vertical frame elements of said sash define internal voids and said vertical sections of said tilt post brackets pass into said voids.

4. The assembly according to claim 3, wherein said vertical sections of said tilt post brackets mechanically engage said vertical frame elements of sash from within said voids.

5. The assembly according to claim 3, wherein said vertical frame elements of said sash define at least one hole and said vertical sections of said tilt post brackets include at least one projection that engage a respective one of said holes.

6. The assembly according to claim 2, wherein said vertical frame elements define recesses into which at least a portion of said vertical sections of said tilt post brackets pass.

7. The assembly according to claim 2, wherein said vertical frame elements of said sash have bottom ends and said vertical sections of said tilt post brackets extend into said vertical frame elements of said sash through openings formed in said bottom ends.

8. The assembly according claim 1, wherein said wound springs are free to move within the tracks with said bracke structures when said brake structures are in said first orientation.

9. The assembly according to claim 1, wherein each of said brake structures contain a hub that passes into said central opening of said respective one of said wound springs, wherein said wound springs are free to rotate as said brake structures move in said tracks.

10. The assembly to claim 1, wherein each of said wound of said brake structures contain at least one flange that contacts an interior surface of said respective one of the tracks when said brake structures are in said second orientation.

11. The assembly according to claim 1, wherein said brake structures are integrally formed as part of said tilt post brackets.

12. The assembly according to claim 1, wherein said brake structures are selectively detachable from said tilt post brackets.

* * * * *